US005165550A

United States Patent [19]

Pierson et al.

[11] Patent Number: 5,165,550

[45] Date of Patent: Nov. 24, 1992

[54] BALL CAGE INSERT AND CAGE SUPPORT FOR SCREENING MACHINE

[75] Inventors: Bruce A. Pierson; William E. Lower, both of Cincinnati, Ohio

[73] Assignee: Rotex, Inc., Cincinnati, Ohio

[21] Appl. No.: 691,148

[22] Filed: Apr. 25, 1991

[51] Int. Cl.[5] ..... B07B 1/28

[52] U.S. Cl. ..... 209/323; 209/409; 209/412

[58] Field of Search ..... 209/323, 330, 347, 379, 209/381, 382, 405, 408, 409, 412, 414

[56] References Cited

U.S. PATENT DOCUMENTS

| | | | |
|---|---|---|---|
| 218,530 | 8/1879 | Holcomb et al. | 209/382 |
| 567,963 | 9/1896 | Dawson | 209/323 |
| 1,562,311 | 11/1925 | Dimm | 209/382 |
| 2,020,013 | 11/1935 | Bailey | 209/323 X |
| 2,149,368 | 3/1939 | Simpson | 209/323 X |
| 2,226,416 | 12/1940 | Simpson et al. | 209/382 |
| 2,395,138 | 2/1946 | Nicholls | 209/323 |
| 2,732,942 | 1/1956 | McLeod et al. | 209/323 |
| 3,565,251 | 2/1971 | Pennington | 209/323 |
| 4,498,981 | 2/1985 | Frevert | 209/381 X |
| 4,526,682 | 7/1985 | Wallace | 209/381 X |
| 5,051,171 | 9/1991 | Hukki | 209/323 |

FOREIGN PATENT DOCUMENTS

| | | | |
|---|---|---|---|
| 2630282 | 6/1977 | Fed. Rep. of Germany | 209/408 |
| 1089947 | 3/1955 | France | 209/323 |
| 1433509 | 10/1988 | U.S.S.R. | 209/405 |

OTHER PUBLICATIONS

"Rotex Screeners" Automatic-Tensioning Models, Catalog 806 1989.

*Primary Examiner*—Joseph E. Vallenza

*Attorney, Agent, or Firm*—Wood, Herron & Evans

[57] ABSTRACT

Disclosed is a ball cleaner for a screening machine in which the ball cages are presented by a molded plastic insert having integral intersecting longitudinal walls and cross walls. The weight of material being screened on the screen which overlies the insert is not carried by the insert but rather by a separate support beneath it. The support comprises a peripheral frame and joists within the frame which directly underlie at least the longitudinal walls of the insert. The insert completely isolates the frame from the erosive action of the cleaning balls and can be replaced separately from the frame.

15 Claims, 2 Drawing Sheets

BALL CAGE INSERT AND CAGE SUPPORT FOR SCREENING MACHINE

FIELD OF THE INVENTION

This invention relates to screening machines, and more particularly to means for dislodging particles which get stuck in the openings of the screens of such machines.

BACKGROUND

In the operation of a screening machine, irregular particles—especially hard, rough materials such as wood chips—which are a little too large to pass all the way through the screen openings sometimes become stuck in screen openings. These effectively close the openings, thereby reducing the area, and hence the capacity, of the screen. Commercial screening machines often incorporate what are called "screen cleaners" which strike the screen while the machine is operating so as to dislodge particles stuck in the screen openings. In one common type of screen cleaner, elastomeric balls are confined in small pockets or "cages" directly beneath the screen and are caused to bounce up against the bottom of the screen to dislodge the particles. In some instances the cage walls are beveled or angulated upwardly; the screening motion of the machine causes the balls to move around in the cages and bounce upwardly off the angled walls, against the screen. The cages have mesh floors with large openings so that particles which fall through the screen above will fall through the cages to an outlet below or onto a finer screen for further screening. Examples of such "ball cleaners" are shown in Holcomb U.S. Pat. No. 218,530; Dawson U.S. Pat. No. 567,963; Dimm U.S. Pat. No. 1,562,311; Simpson U.S. Pat. No. 2,226,416; and Frevert U.S. Pat. No. 4,498,981.

In many situations commercial machines are required to run for extended periods without shut down. Eventually the vigorous bouncing action of the balls on the cage walls and floor wears or erodes the balls and the cage itself, as well as the screen. The wear is most rapid on the screen itself, but continued abrasion of the balls on the floor and the walls of the cage (which are often made of wood) gradually weakens the cage. The cage walls underlie and support the screen, which rests on the tops of the walls. If the walls are eroded too much they can no longer support the weight of the particulate material on the screen, and they may collapse. To prevent that, the entire ball cleaner must be replaced at intervals, which is a significant delay and expense. In some cases metal cages have been used rather than wood, but they are more expensive and it is more difficult to mount a wire mesh floor to them.

Pennington U.S. Pat. No. 3,565,251 attempts to solve the problem of cage wear by providing a plastic cage insert which is surrounded by a supporting peripheral frame. When the plastic is worn, the entire insert can be removed and replaced. The weight of the screen and particle load on the screen rests on and is carried by the plastic insert. The insert must be heavy to withstand the loading, which increases its cost, and as it wears its ability to carry the load decreases. Moreover, engagement of the top edge of the cage walls with the screen increases the rate of wear of the insert.

BRIEF SUMMARY OF THE INVENTION

In accordance with the present invention a ball cleaner is provided in which the load support function is separated from the function of encaging the balls. The balls are confined in a molded plastic cage insert, but the insert is not loaded by the weight of the screen. The insert is carried in a support which supports the insert centrally as well as peripherally. The support has "joists" which underlie the longitudinal walls of the insert and hold them upwardly against the screen to support it. Cross walls of the insert intersect its longitudinal walls to define the cages, but the cross walls are spaced below the screen and are not necessarily underlain by the support. With this structure the ball action wears the insert only; the balls do not contact the support or degrade its structural strength, yet the load of the screen puts little stress on the insert. When the insert becomes overly worn from ball action and/or from particle abrasion it can be replaced relatively inexpensively in the same support.

It has been found that the plastic cage walls wear much less than wood cage walls, but that plastic does not support the screen as well as wood. By supporting the cage walls, or some of them, on spaced joists, the insert can be made lighter in weight yet still sufficiently strong to serve its function of confining the ball cleaners.

DESCRIPTION OF THE DRAWINGS

The invention can best be further described by reference to the accompanying drawings, in which.

DETAILED DESCRIPTION

Figure 1:
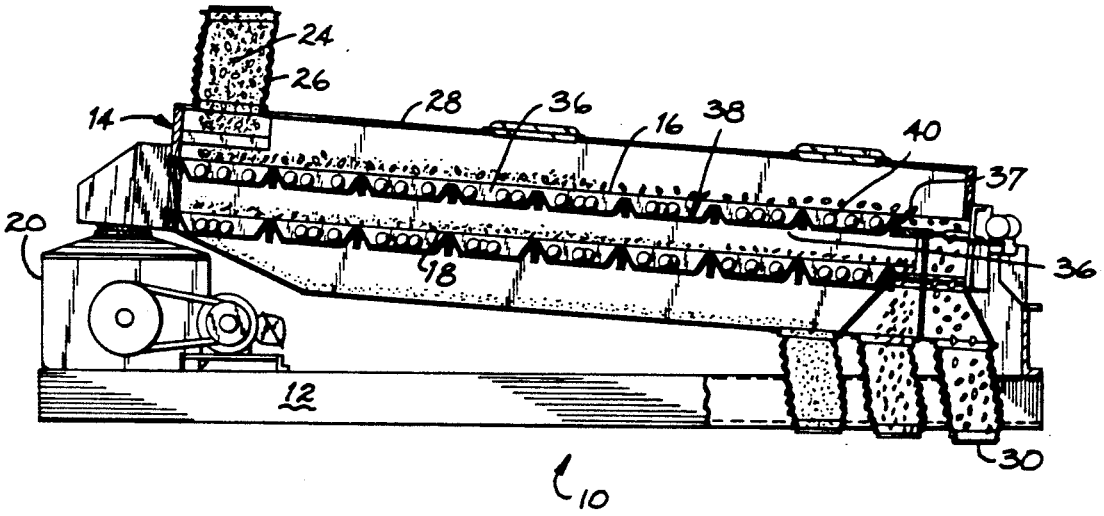
FIG. 1 is a vertical longitudinal section of a screening machine having cleaning screen means in accordance with the invention.

The machine designated generally by 10 in FIG. 1 is "Rotex" brand commercial screening machine and represents one type of machine in which the screen cleaning means of the invention can be used, although it should be understood that the invention is not limited to use only with screening machines. The machine 10 has a stationary base 12 on which a screen deck or box 14 is mounted for screening movement. Box 14 mounts one or more screens; in the embodiment shown it has two screens, a relatively coarse top screen or "clothing" 16 and a finer bottom screen 18. Screen box 14 and the screens 16 and 18 in it are moved in screening motion by an eccentric drive 20 which is connected to the head (upper) end of the box 14. The motion of the head end of the box is nearly circular; at the lower or tail end the motion is narrowly elliptical. The particulate material 24 to be screened is delivered by a chute 26 through the top cover 28 of the box onto top screen 16 at the head end. The screening motion conveys the coarser particles downwardly on the screen, and particles finer than the openings of screen 16 fall through it onto bottom screen 18 for further screening. The overs which do not fall through are discharged off the tail end of screen 16 into a chute 30.

Figure 3:
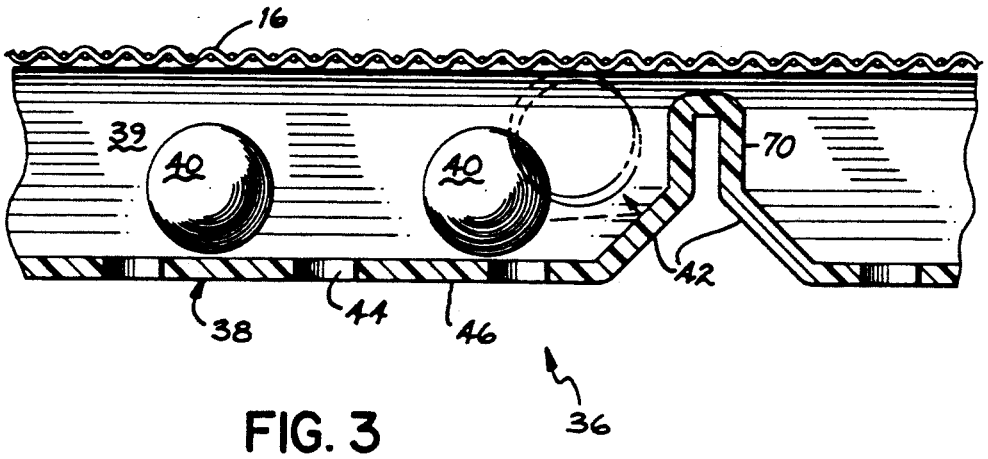
FIG. 3 is an enlarged vertical section view taken on line 3—3 of FIG. 2.

Over a period of time, particles having a dimension approximating that of the openings of screen 16 will become lodged in the screen openings. Some are dislodged by the screening motion or by the flow of particles past them, but to the extent they are not dislodged they "blind" the screen and reduce its effective screening area. To clear particles stuck in the screen openings, a ball cleaner designated generally by 36 is provided, directly below screen 16. (The embodiment shown also has a similar ball cleaner beneath lower screen 18.) Ball cleaner 36 comprises two basic components, a frame support 37 and a molded plastic cage insert 38 which rests on and is carried by support 37. Insert 38 presents an array of pockets or cages 39 which underlie the area of the screen over it. The cages are typically rectangular or square in plan, although they may have other shapes if the application warrants. Each cage has beveled or upwardly sloping wall surfaces 42 and contains several cleaning balls 40. The downward tilt of screen box 14, together with the screening motion, shakes the balls in their respective cages so that they hit the beveled walls 42 of the cages. This deflects them upwardly, as shown by the dotted lines in FIG. 3, and they hit the underside of screen 16. Particles which pass through the openings of screen 16 fall through the cages and pass through large openings 44 in the floors of the cages, see FIG. 3.

The balls contact only the plastic insert 38 and the screen 16 above it; that is, they are entirely isolated from the support 37. The balls do not impinge on the frame surfaces. However, the weight of the material being screened is essentially carried by the support, and not by the insert. When the cage wall surfaces do eventually wear thin from the ball action, the entire insert 38 can be replaced relatively inexpensively, into the same support structure 37; the support itself is not eroded and need not be replaced when the insert is replaced.

Figure 2:
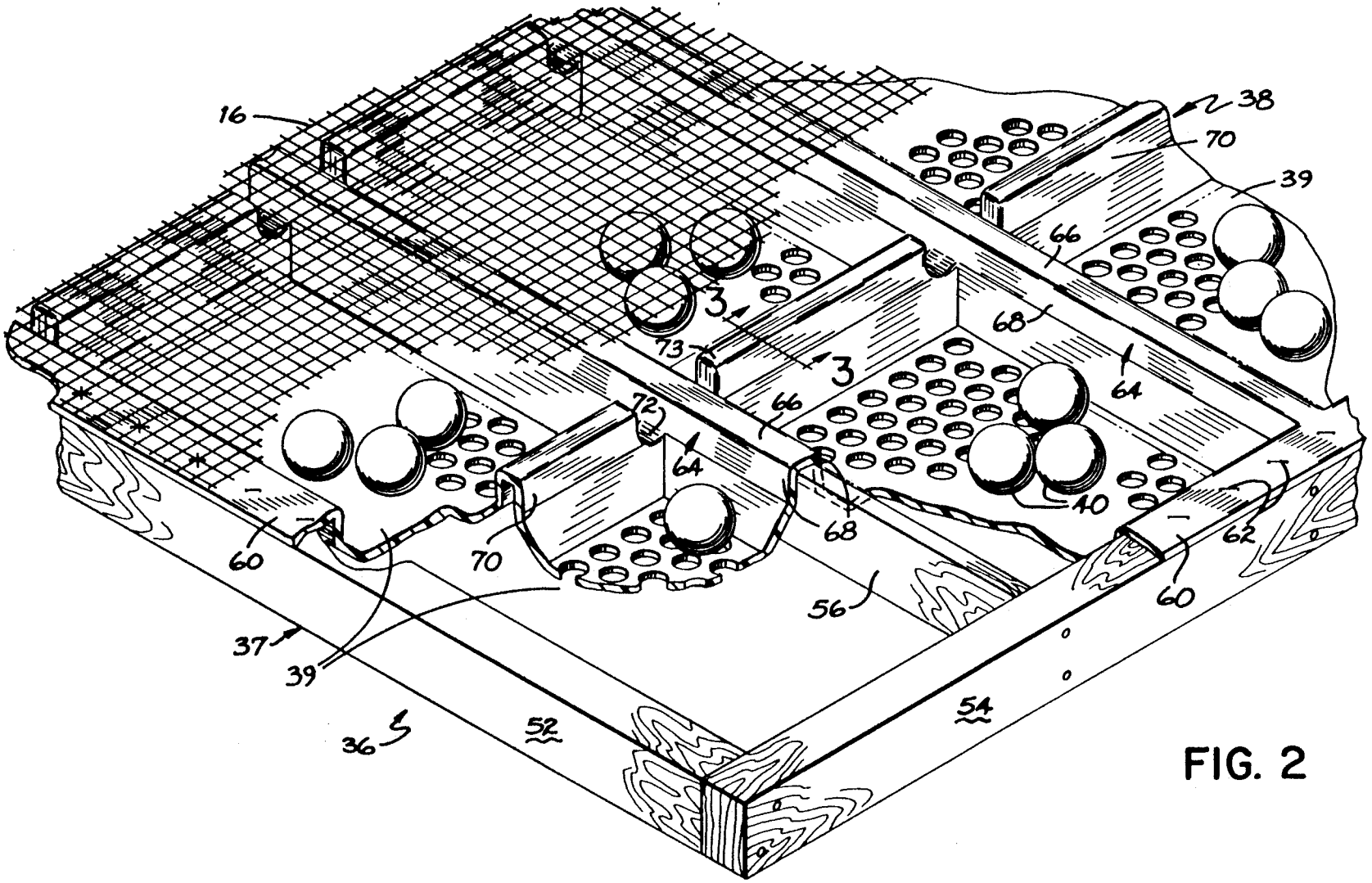
FIG. 2 is a perspective view, partly broken away, showing a preferred form of the insert and the support.

FIG. 2 of the drawing shows the presently preferred configuration of support 37 and insert 38. The support has a rectangular peripheral frame having side members 52 and end members 54 which may be wood beams (for example $1\frac{1}{4}\times2\frac{1}{4}$ inches in size), although metal channels or flanges could be used. Within the peripheral frame defined by members 52 and 54, support 37 has parallel longitudinal stringers or joists 56. These preferably extend longways, i.e., between opposite end members 54, parallel to the side members 52. In the preferred form, no cross stringers are provided.

Cage insert 38 is preferably formed from a single unitary sheet of plastic, and has overall dimensions corresponding to the outside dimensions of support 37. The insert has a peripheral flange 60 which rests on and is secured (as by staples 62 or screws) to the support side and end members 52, 54. Longitudinal walls or dividers 64 of the insert extend across the insert parallel to joists 56, between the flanges 60 at the ends. The longitudinal walls 64 are preferably in the form of downwardly opening channels having top surfaces 66 and vertical sides 68 which lead downwardly to bevel surfaces 42. The channels defined between the vertical sides 68 are shaped and positioned to receive and embrace the corresponding joists 56 with channel top surfaces 66 resting on the top edges of the joists. The top surfaces 66 are preferably co-planar with peripheral flange 60. Screen 16 may be secured to support 37 at the sides and ends 52, 54, through the flange 60 of the insert. Under load, the screen rests on the top surfaces 66 of the longitudinal walls 64.

Insert 38 also has integral cross walls 70 which, in the embodiment shown, are perpendicular to the longitudinal walls 64. The cross walls preferably have beveled surfaces 42, like those of the longitudinal walls, to enhance the bouncing action, it being desirable that the balls impact the screen uniformly above the cages. Cross walls 70 have a sectional shape similar to that of the walls 64, but the tops 73 of the cross walls are preferably lower than the tops 66 of the longitudinal walls. The screen does not contact the cross wall tops 73, and its effective screen area is thereby increased. There is preferably a recess or dip 72 between the top 73 of each cross wall 70 and the top 66 of the longitudinal wall 64; the bevel surfaces 42 and the vertical walls 68 of adjacent longitudinal and cross walls meet at the corner, but their top surfaces do not. The recesses 72 have been found to stiffen the insert at those locations, and thereby reduce bending.

The individual cages 39 are preferably of modular or standard sizes so that inserts can more easily be molded to fit screening machines of a range of different sizes. For example, modular cage sizes of 18"×24" or 24"×30" can be used. In the preferred embodiment, which is shown, the floor 46 of each cage is integral and has round punched openings 44 which permit material from the screen 16 above to fall through freely. The sheet can be vacuum formed to the desired configuration, and the openings 44 punched in the floor. Alternatively, the insert may be open at the bottoms of the cages, and a separate wire mesh bottom secured to the frame, beneath the insert. Use of a convoluted wire mesh cage bottom enhances the bouncing action of the balls; the wire can be formed with more abrupt convolutions than the floor of a vacuum formed insert, thereby to cause more random bouncing.

The insert is preferably made of high density, high molecular weight polyethylene such as Phillips 50–100. Tests have demonstrated that an insert made of one-quarter inch thick, HDHMW polyethylene, having 21 cages in a 3×7 array, has much longer life in use than a conventional ball cleaner with wooden sides and an attached wire mesh floor.

Having described the invention, what claimed is:

1. In a screening machine having a screen and a ball cleaning means mounted beneath said screen, the improvement wherein said cleaning means comprises, a cage support and a cage insert carried by said support, said support comprising a peripheral frame and spaced joists within said frame, said insert being molded of plastic and having integral upstanding longitudinal walls and cross walls which intersect said longitudinal walls, said longitudinal walls being located directly above and supported by said joists of said support;

means presenting an apertured cage floor;

said screen, longitudinal walls, cross walls and floor means defining cages for cleaning balls, cleaning balls in said cages, said screen resting on said longitudinal walls, said walls transmitting the weight of a material being screened on said screen to said support structure, said walls of said insert isolating said support from erosive action of said balls in use.

2. The improvement of claim 1 wherein said longitudinal walls are in the form of downwardly opening channels.

3. The improvement of claim 2 wherein said joists are received in the respective channels, and said channels of said longitudinal walls have top portions which rest on said joists.

4. The improvement of claim 2 wherein said cross walls are also in the form of downwardly opening channels, no joists being received in the channels of said cross walls.

5. The improvement of claim 4 wherein said insert includes a peripheral flange which rests on the peripheral frame of said support, said top portions of said longitudinal walls are coplanar with said flange, said longitudinal walls and flange in use engaging and supporting a screen of a screening machine.

6. The improvements of claim 5 wherein said cross walls have top portions which are spaced below said top portions of said longitudinal walls and which in use do not engage the screen of a screening machine.

7. The improvements of claim 3 wherein said cross walls have top portions which are spaced laterally by recesses from the top portions of said longitudinal walls, said recesses reducing bending where said cross walls intersect the longitudinal walls.

8. The improvements of claim 1 further wherein said insert has a peripheral flange, said flange positioned on the said peripheral frame of said support.

9. The improvements of claim 1 wherein said longitudinal walls have bevels which slope downwardly and outwardly to deflect a ball upon impact.

10. The improvements of claim 1 wherein said cross walls have bevels which slope downwardly and outwardly to deflect a ball upon impact.

11. In a screening machine having a screen and a ball cleaning means mounted beneath said screen, the improvement wherein said cleaning means comprises, a cage support and a cage insert carried by said support, said support comprising a peripheral frame and spaced joists within said frame, said insert being molded of plastic and having integral upstanding longitudinal walls and cross walls which intersect said longitudinal walls, said longitudinal walls being located directly above and supported by said joists of said support;

means presenting an apertured cage floor;

said screen, longitudinal walls, cross walls and floor means defining cages for cleaning balls, cleaning balls in said cages, said screen resting on said longitudinal walls, said walls transmitting the weight of a material being screened on said screen to said support structure, said walls of said insert isolating said support from erosive action of said balls in use, said longitudinal walls being in the form of downwardly opening channels with substantially vertical wall portions and downwardly and outwardly beveled surfaces below said vertical wall portions.

12. The improvements of claim 11 wherein said joists are embraced between said vertical wall portions of said longitudinal walls.

13. The improvements of claim 1 wherein said floor means is integral with said insert.

14. The improvement of claim 1 wherein said insert is formed of sheet plastic.

15. The improvement of claim 1 wherein said plastic is high density, high molecular weight polyethylene.

* * * * *